United States Patent [19]

Isozumi et al.

[11] Patent Number: 4,970,908

[45] Date of Patent: Nov. 20, 1990

[54] ENGINE STARTER APPARATUS

[75] Inventors: Shuzou Isozumi; Keiichi Konishi, both of Himeji, Japan

[73] Assignee: Mitsubishi Denki Kabushiki Kaisha, Tokyo, Japan

[21] Appl. No.: 489,621

[22] Filed: Mar. 7, 1990

[30] Foreign Application Priority Data

Mar. 8, 1989 [JP] Japan ..... 1-56649

[51] Int. Cl.[5] ..... F02N 11/00

[52] U.S. Cl. ..... 74/7 E; 74/6; 290/48

[58] Field of Search ..... 74/6, 7 R, 7 E; 123/179 M; 290/38 R, 38 C, 48

[56] References Cited

U.S. PATENT DOCUMENTS 4,776,224 10/1988 Maezawa et al. ..... 74/7 E
4,800,766 1/1989 Isozumi et al. ..... 74/7 E

FOREIGN PATENT DOCUMENTS 63-90665 4/1988 Japan .

*Primary Examiner*—Leslie A. Braun
*Assistant Examiner*—Scott Anchell
*Attorney, Agent, or Firm*—Sughrue, Mion, Zinn, Macpeak and Seas

[57] ABSTRACT

An engine starter apparatus being arranged such that a rotational force from an electric motor is transmitted to an output rotary shaft through a planetary speed reduction gear. The number Zs of teeth of a sun gear, the number Zp of teeth of a planet gear, the number Zi of teeth of an internal gear and the number N of the planet gears satisfy the equation $(Zs+Zi)N=$an integer, and the pressure angle $\alpha bi$ of the engagement between the planet gear and the internal gear is arranged to be $\cos^{-1}\{(Zi-Zp)/(Zs+Zp)\times\cos\alpha bs\}$, where $\alpha bs$ is the pressure angle of the engagement between the sun gear and the planet gear.

1 Claim, 1 Drawing Sheet

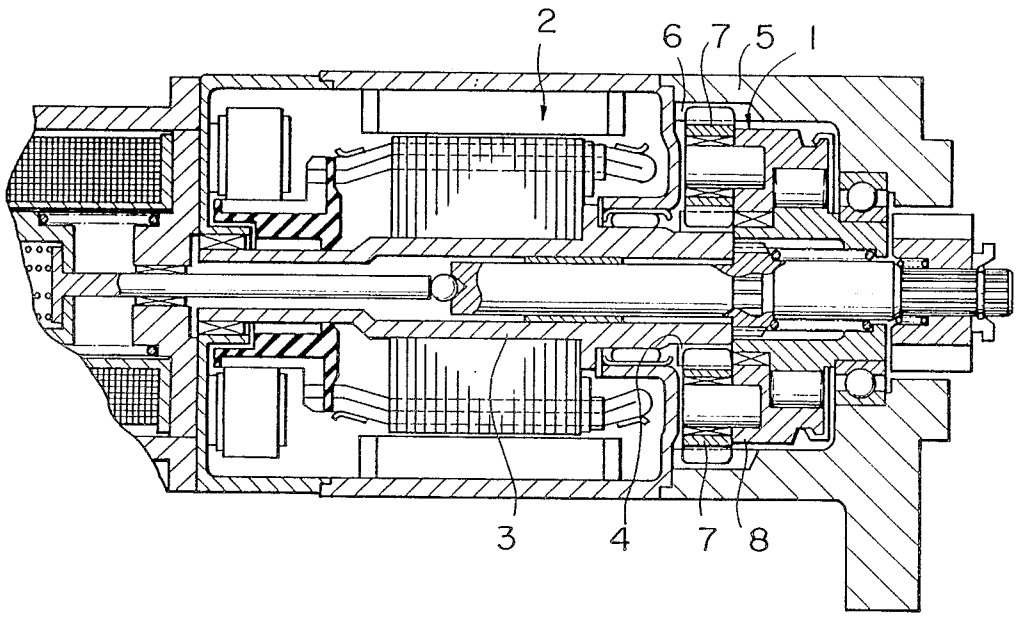
1
5
7
6
2
8
7
4
3

ENGINE STARTER APPARATUS

BACKGROUND OF THE INVENTION

This invention relates to an engine starter apparatus and, more particular, to an engine starter apparatus provided with a planetary gear speed reduction mechanism.

An engine starter apparatus having a planetary speed reduction gear is known as disclosed in Japanese Patent Laid-Open No. 63-90665, for example. The engine starter apparatus disclosed in this Laid-Open is the so-called coaxial starter apparatus in which a solenoid switch is disposed behind a d.c. motor, and the planetary speed reduction gear 1 comprises, as illustrated in the FIGURE, a sun gear 4 formed on the outer circumference of the front end of an armature rotary shaft 3 of a d.c. motor 2, an internal gear 6 formed in the inner circumferential surface of a machine frame 5 disposed outside of the sun gear 4, three planet gears 7 rotating between the sun gear 4 and the internal gear 6, and a carrier 8 rotatably supporting and connecting each of the planet gears 7.

In the illustrated planetary speed reduction gear 1, when the numbers of teeth of the sun gear 4, the internal gear 6 and the planet gear 7 are Zs, Zi and Zp, respectively, the relationship between the number of teeth of each of the gears 4, 6 and 7 is determined so that they satisfy the equation of $(Zs+Zi)/N$=an integer (where, N is the number of the planet gears 7), which is the engagement condition for the plurality of planet gears, and the equation of $Zi=Zs+2Zp$, which is the engagement condition for a single planet gear, as well as the range of $Zs \geqq 11$ and $Zi \leqq 46$, with the module $M=1.25$ for the reasons of mechanical strength of the armature rotary shaft 3 on which the sun gear 4 is formed and the installation lay-out of the starter apparatus with respect to the engine. This relationship can be expressed in a table shown in Table 1 in conjunction with various combinations of gears 4, 6 and 7 when Zs is 11, Zp is 16, 17 or 18, and Zi is one of 41–49.

TABLE 1

| No. | Numbers of Teeth Zs | Zp | Zi | Zs + 2Zp − Zi | Planetary Speed Reduction Ratio g | (Zs + Zi)/N = Integer N = 3 |
|---|---|---|---|---|---|---|
| 1 | 11 | 16 | 41 | +2 | 4.73 | X |
| 2 | " | " | 42 | +1 | 4.82 | X |
| 3 | " | " | 43 | 0 | 4.91 | O |
| 4 | " | " | 44 | −1 | 5.0 | X |
| 5 | " | " | 45 | −2 | 5.09 | X |
| 6 | " | 17 | 43 | +2 | 4.91 | O |
| 7 | " | " | 44 | +1 | 5.0 | X |
| 8 | " | " | 45 | 0 | 5.09 | X |
| 9 | " | " | 46 | −1 | 5.18 | O |
| 10 | " | " | 47 | −2 | 5.27 | X |
| 11 | " | 18 | 45 | +2 | 5.09 | X |
| 12 | " | " | 46 | +1 | 5.18 | O |
| 13 | " | " | 47 | 0 | 5.27 | X |
| 14 | " | " | 48 | −1 | 5.36 | X |
| 15 | " | " | 49 | −2 | 5.45 | O |

As apparent from Table 1, the gear arrangement that satisfies the previously discussed conditions is the third combination, in which Zs is 11, Zp is 16 and Zi is 43, and therefore the conventional planetary speed reduction gear 1 is arranged according to this combination, so that the planetary speed reduction ratio g obtained by $g=1+(Zi/Zs)$ is 4.91.

Demands for miniaturizing various car equipments is increasing in view of reduction of weight and efficient use of the space within the engine compartment of a vehicle, and the engine starter apparatus is not an exception. One measure for miniaturizing the engine starter apparatus includes miniaturization of the d.c. motor, which may be realized by increasing the planetary speed reduction ratio g. In this case, from the previous equation $g=1+(Zi/Zs)$, either the number of teeth Zs of the sun gear 4 can be decreased or the number of teeth Zi of the internal gear 6 can be increased.

However, since the number of teeth Zs of the sun gear 4 and the number of teeth Zi of the internal gear 6 is determined according to the previously described restriction, these numbers of teeth of the gears 4 and 6 cannot be changed under the condition that at least the performance of the conventional engine starter apparatus be maintained (not decreasing the speed reduction ratio), so that there was a problem that the miniaturization of the d.c. motor by increasing the planetary speed reduction ratio g is very difficult.

SUMMARY OF THE INVENTION

Accordingly, one object of the present invention is to provide an engine starter apparatus free from the above-discussed problems of the conventional engine starter apparatus.

Another object of the present invention is to provide an engine starter apparatus of a small size.

Another object of the present invention is to provide an engine starter apparatus in which the electric motor is miniaturized by increasing the planetary speed reduction ratio of the planetary speed reduction gear.

With the above objects in view, the engine starter apparatus of the present invention is arranged such that a rotational force from an electric motor is transmitted to an output rotary shaft through a planetary speed reduction gear. The number Zs of teeth of a sun gear, the number Zp of teeth of a planet gear, the number Zi of teeth of an internal gear and the number N of the planet gears satisfy the equation $(Zs+Zi)/N$ =an integer, and the pressure angle $\alpha bi$ of the engagement between the planet gear and the internal gear is arranged to be $\cos^{-1}\{(Zi-Zp)/(Zs+Zp)\times\cos\alpha bs\}$, where $\alpha bs$ is the pressure angle of the engagement between the sun gear and the planet gear.

In the engine starter apparatus of the present invention in which a rotational force from the electric motor is transmitted to the output rotary shaft through the planetary speed reduction gear, the numbers of teeth of each of the gears of the planetary speed reduction gear are determined in accordance with the conditions of $(Zs+Zi)/N$=an integer as well as the mechanical strength such as the shaft strength and the machine frame dimention, and the pressure angle of the engagement between the planet gear and the internal gear is determined to have a predetermined relationship with respect to the pressure angle of the engagement between the sun gear and the planet gear, so that the selection rage of the numbers of teeth of each gear is enlarged, enabling that the planetary speed reduction ratio to be increased.

BRIEF DESCRIPTION OF THE DRAWING

The present invention will become more readily apparent from the following detailed description of the preferred embodiment of the present invention taken in conjunction with the accompanying drawings, in which:

The sole FIGURE is a sectional view illustrating one example of an engine starter apparatus to which the present invention is applicable.

DESCRIPTION OF THE PREFERRED EMBODIMENT

The engine starter apparatus of the present invention will now be described in detail in conjunction with an embodiment.

The engine starter apparatus of one embodiment of the present invention has the same basic structure as that of the conventional starter apparatus, but is different in the number of teeth including the numbers of teeth of the sun gear 4, the internal gear 6 and the planet gears 7 of the planetary speed reduction gear 1.

More particularly, the planetary speed reduction gear 1 of the starter apparatus of the present invention is constructed under the first condition which requires that the numbers of teeth of the sun gear 4 and the internal gear 6 satisfies the previous equation $(Zs+Zi)/N$=an integer. As the second condition, the teeth of each of the gears 4, 6 and 7 are formed such that the pressure angle $\alpha$bi of the engagement between the planet gear 7 and the internal gear 6 is determined to have a predetermined relationship with respect to the pressure angle $\alpha$bs of the engagement between the sun gear 4 and the planet gear 7. This "predetermined relationship" is $\alpha bi = \cos^{-1}\{(Zi-Zp)/(Zs+Zp)\times\cos\alpha bs\}$. Therefore, it is not necessary that the equation $Zi=Zs+2Zp$ which is a conventional engagement condition for a single planet gear be satisfied. In other words, this equation is a condition for the case where a standard gear is used, and in the planetary speed reduction gear of the starter apparatus of the present invention, the standard gear is not used and the mechanical engagement condition is determined on the basis of the relationship of the pressure angle of the engagement between each gear. Therefore, a profile shifted gear is used as one of the measures for maintaining the engagement pressure angle between the gears 4, 6 and 7 to the previously discussed predetermined relationship. The profile shifted gear refers to the gear in which the reference pitch line is inwardly and outwardly shifted by X·m from the teeth cutting pitch circle during the manufacturing of the gear teeth. Where, X is a profile shift factor, which is known to be relatively freely selectable, and the most optimum value suitable to the use purpose and the material used is adopted considering the gear performance with various profile shift during designing.

Thus, by forming a profile shifted gear which satisfies the previous equation of the engagement pressure angle by selecting a shift factor, an engagement relationship as the planetary gear mechanism can be established by using a gear which does not satisfy the equation $Zi=Zs+2Zp$. In this case, the combinations of each gear 4, 6 and 7 are greatly increased and can be used in terms of all combinations satisfying the restriction due to the strength of the shaft and the gears or the restriction due to the machine frame dimensions determined by the engine lay-out and the condition of $(Zs+Zi)/N$=an integer.

Studying such combinations in conjunction with the previous Table 1 in which preferable range usable in the engine starter apparatus, it is seen that, in addition to 3rd combination used in the conventional starter apparatus, 6th, 9th, 12th and 15th combinations are realizable. However, since $Zs \geqq 11$ and $Zi \leqq 46$ are preferable where the module $M = 1.25$ for example, 15th combination can be eliminated, and 9th or 12th combination ($g=5.18$) which has the largest planetary speed reduction gear g among these combinations is selected. In other words, when the gears formed with the numbers of teeth selected as previously described for the sun gear 4, the internal gear 6 and the planet gears 7 of the planetary speed reduction gear, the planetary speed reduction ratio can be increased within the range applicable to the starter apparatus. With the higher planetary speed reduction ratio, the d.c. motor can be made smaller, resulting in a reduced over-all dimension of the starter apparatus.

As has been described, according to the starter apparatus of the present invention, the teeth as well as the number of teeth of the sun gear, the internal gear and the planet gear of the planetary speed reduction gear are selected and formed to satisfy the previously described relationships, so that the planetary speed reduction ratio can be made larger than that of the conventional design, enabling the electric motor to be smaller, resulting in a smaller over-all dimensions of the starter apparatus.

What is claimed is:

1. A starter apparatus in which a rotational force from an electric motor is transmitted to an output rotary shaft through a planetary speed reduction gear, characterized in that, where the number of teeth of a sun gear is Zs, the number of teeth of a planet gear is Zp, the number of teeth of an internal gear is Zi and the number of said planet gears is N, each of said gears satisfies $(Zs+Zi)/N$=an integer, and where the pressure angle of the engagement between the sun gear and the planet gear is $\alpha$bs, the pressure angle $\alpha$bi of the engagement between the planet gear and the internal gear is arranged to be $\cos^{-1}\{(Zi-Zp)/(Zs+Zp)\times\cos\alpha bs\}$.

* * * * *